US007237731B2

(12) United States Patent
Dallmeyer et al.

(10) Patent No.: US 7,237,731 B2
(45) Date of Patent: Jul. 3, 2007

(54) FUEL INJECTOR WITH A DEEP POCKET SEAT AND METHOD OF MAINTAINING SPATIAL ORIENTATION

(75) Inventors: Michael P. Dallmeyer, Newport News, VA (US); William J. Imoehl, Williamsburg, VA (US); James P. Fochtman, Williamsburg, VA (US); Fredrick L. Barnes, Suffolk, VA (US)

(73) Assignee: Siemens VDO Automotive Corporation, Auburn Hills, MI (US)

( * ) Notice: Subject to any disclaimer, the term of this patent is extended or adjusted under 35 U.S.C. 154(b) by 321 days.

(21) Appl. No.: 10/642,629

(22) Filed: Aug. 19, 2003

(65) Prior Publication Data

US 2005/0040259 A1 Feb. 24, 2005

(51) Int. Cl.

| | |
|---|---|
| ***B05B 1/30*** | (2006.01) |
| ***F02M 51/00*** | (2006.01) |
| ***F02M 61/10*** | (2006.01) |
| ***F02M 61/20*** | (2006.01) |

(52) U.S. Cl. ..... 239/585.4; 239/585.5; 239/585.1; 239/533.9; 239/533.11

(58) Field of Classification Search ..... 239/585.4, 239/585.5, 585.1, 533.9, 533.11, 533.2, 533.3, 239/585.2, 585.3, 88

See application file for complete search history.

(56) References Cited

U.S. PATENT DOCUMENTS

| | | | | |
|---|---|---|---|---|
| 5,165,656 | A * | 11/1992 | Maier et al. | 251/129.21 |
| 5,996,911 | A * | 12/1999 | Gesk et al. | 239/585.1 |
| 6,264,112 | B1 * | 7/2001 | Landschoot et al. | 239/5 |
| 6,279,841 | B1 * | 8/2001 | McCormick | 239/585.1 |
| 6,328,232 | B1 * | 12/2001 | Haltiner et al. | 239/585.1 |
| 6,390,067 | B1 * | 5/2002 | Haltiner et al. | 123/470 |
| 6,572,028 | B1 * | 6/2003 | Fly et al. | 239/5 |
| 6,789,754 | B2 * | 9/2004 | Peterson, Jr. | 239/533.2 |

* cited by examiner

*Primary Examiner*—David A. Scherbel
*Assistant Examiner*—Darren Gorman

(57) ABSTRACT

A fuel injector has a housing extending along a longitudinal axis between an inlet and an outlet. A seat assembly is disposed in a body proximate the outlet. The seat assembly includes a flow portion and a securement portion. The flow portion extends along the longitudinal axis between a first surface and an orifice disk retention surface at a first length. The flow portion has a seat orifice extending therethrough and an orifice disk coupled to the orifice disk retention surface so that the orifice plate is aligned in a fixed spatial axial orientation with respect to the flow portion. The securement portion extends along the longitudinal axis away from the orifice disk retention surface at a second length greater than the first length. A method of maintaining a fixed spatial axial orientation and dimensional symmetry of at least one of the seat and orifice disk in the body is disclosed.

16 Claims, 2 Drawing Sheets

FUEL INJECTOR WITH A DEEP POCKET SEAT AND METHOD OF MAINTAINING SPATIAL ORIENTATION

BACKGROUND OF THE INVENTION

It is believed that a seat of a conventional fuel injector can be attached to a body by placing the seat and an orifice disk within the body and crimping a terminal portion of the body to retain the seat and the orifice disk within the body.

However, the crimping of the seat to the body may cause movement of the seat relative to a desired position in the body. Further, the seat, orifice disk, or the body may also distort at a location proximate the terminal end of the body.

The change in seat location relative to the body may cause the working gap between an armature and a pole piece of the conventional fuel injector to be changed, thereby changing the desired flow rate.

The distortion of the seat may cause the integrity of the sealing surface formed between a closure member and the seat to be changed, thereby potentially affecting emission due to leaks during a closed configuration of the fuel injector.

The distortion of the seat and/or the orifice disk may cause the fuel spray pattern and targeting to be unsuitable (e.g., insufficient atomization or inappropriate spray pattern) in the manifold or in the intake port of the engine.

Thus, it would be desirable to attach the seat to a body without the potential shortcomings of the conventional fuel injector. Moreover, it would be desirable to maintain symmetry of the seat and/or the orifice disc with respect to a longitudinal axis.

SUMMARY OF THE INVENTION

The present invention provides for, in one aspect, a fuel injector. The fuel injector comprises a housing, a body, and an armature assembly. The housing has a passageway extending between an inlet and an outlet along a longitudinal axis with a body proximate the outlet. The armature assembly is disposed in the body and has a closure member. The seat assembly is disposed in the body. The seat assembly includes a flow portion and a securement portion. The flow portion extends along the longitudinal axis between a first surface and an orifice disk retention surface at a first length. The flow portion has a seat orifice extending therethrough and an orifice disk coupled to the orifice disk retention surface so that the orifice plate is aligned in a fixed spatial axial orientation with respect to the flow portion. The securement portion extends along the longitudinal axis away from the orifice disk retention surface at a second length greater than the first length.

In yet another aspect, the present invention provides for a method of maintaining a fixed spatial axial orientation of a seat and an orifice disk in a body that extends along a longitudinal axis. The method can be achieved by disposing the seat and the orifice disk in a valve body of the valve subassembly in a fixed spatial axial orientation; and welding the seat to the valve body so that the fixed spatial axial orientation is maintained with in a tolerance of ±0.5%.

BRIEF DESCRIPTION OF THE DRAWINGS

The accompanying drawings, which are incorporated herein and constitute part of this specification, illustrate an embodiment of the invention, and, together with the general description given above and the detailed description given below, serve to explain the features of the invention.

DETAILED DESCRIPTION OF THE PREFERRED EMBODIMENTS

Figure 1:
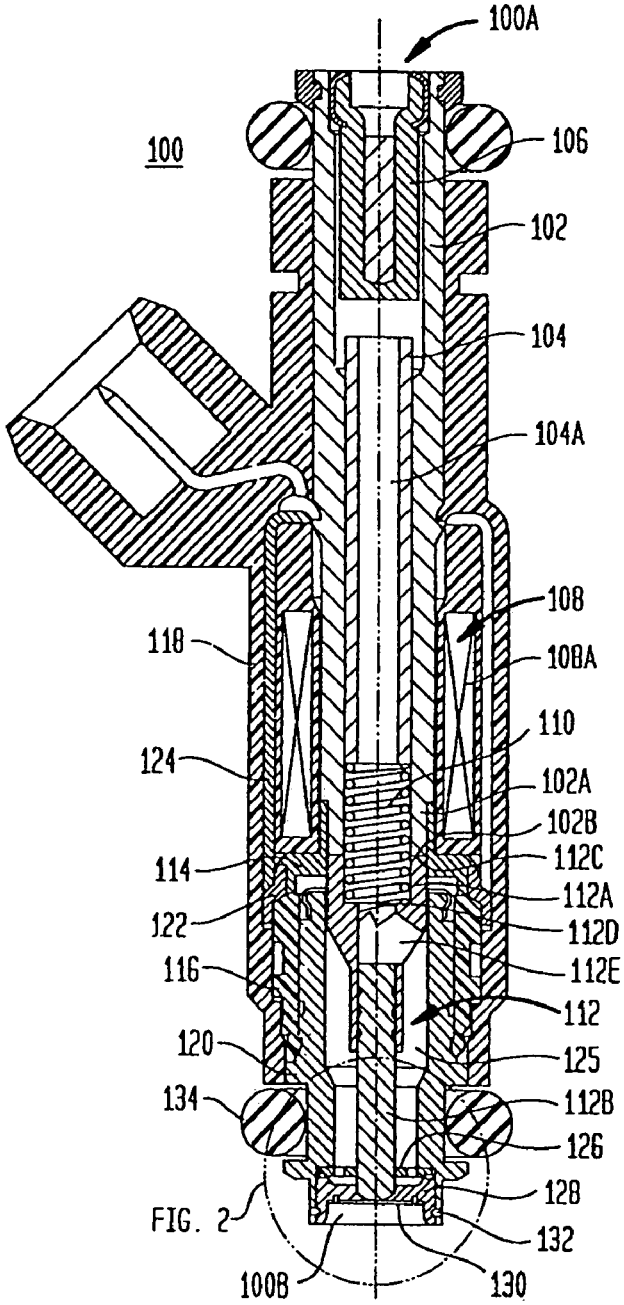
FIG. 1 is a representation of a fuel injector according a preferred embodiment.
Figure 2:
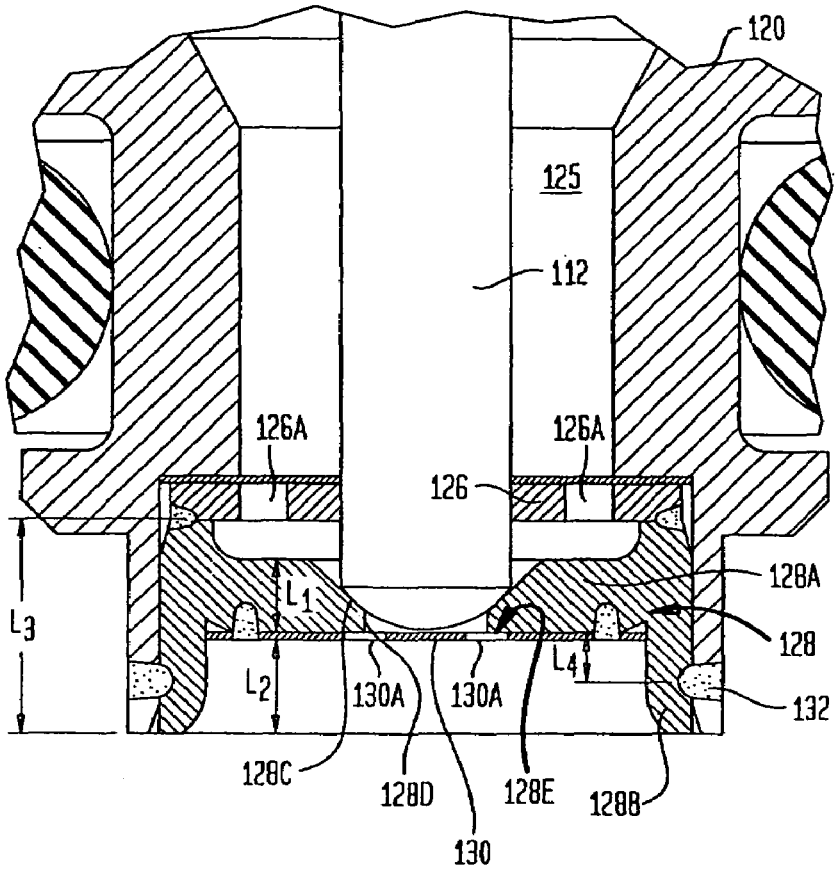
FIG. 2 is a close up of the outlet end of the fuel injector of FIG. 1.

FIGS. 1 and 2 illustrate the preferred embodiment of a fuel injector 100. In particular, the fuel injector 100 has a housing that includes an inlet tube 102, adjustment tube 104, filter assembly 106, coil assembly 108, biasing spring 110, armature assembly 112 with an armature 112A and closure member 112B, non-magnetic shell 114, a first overmold 116, second overmold 118, a body 120, a body shell 122, a coil assembly housing 124, a guide member 126 for the closure member 112A, a seat 128, and an orifice disk 130.

Armature assembly 112 includes a closure member 112B. The closure member 112B can be a suitable member that provides a seal between the member and a sealing surface of the seat 128 such as, for example, a spherical member or a needle member with a hemispherical surface. Preferably, the closure member 112B is a needle with a generally hemispherical end. The closure member 112B can also be a one-piece member of the armature assembly 112.

Coil assembly 108 includes a plastic bobbin on which an electromagnetic coil 118A is wound. Respective terminations of coil 108A connect to respective terminals that are shaped and, in cooperation with a surround 118A, formed as an integral part of overmold 118, to form an electrical connector for connecting the fuel injector 100 to an electronic control circuit (not shown) that operates the fuel injector 100.

Inlet tube 102 can be ferromagnetic and includes a fuel inlet opening at the exposed upper end. Filter assembly 106 can be fitted proximate to the open upper end of adjustment tube 104 to filter any particulate material larger than a certain size from fuel entering through inlet opening 100A before the fuel enters adjustment tube 104.

In the calibrated fuel injector 100, adjustment tube 104 can be positioned axially to an axial location within inlet tube 102 tat compresses preload spring 110 to a desired bias force. The bias force urges the armature/closure to be seated on seat 128 so as to close the central hole through the seat. Preferably, tubes 102 and 104 are crimped together to maintain their relative axial positioning after adjustment calibration has been performed.

After passing through adjustment tube 104, fuel enters a volume that is cooperatively defined by confronting ends of inlet tube 102 and armature assembly 112 and that contains preload spring 110, Armature assembly 112 includes a passageway 112E that communicates volume 125 with a passageway 104A in body 120, and guide member 126 contains fuel passage holes 126A. This allows fuel to flow from volume 125 through passageways 112E to seat 128.

The upper end of body 120 fits closely inside the lower end of body shell 122 and these two parts are joined together in fluid-tight maimer, preferably by laser welding. Armature assembly 112 can be guided by the inside wall of body 120 for axial reciprocation. Further axial guidance of the mature/closure member assembly can be provided by a central guide hole in member 126 through which closure member 112A passes.

Surface treatments can be applied to at least one of the end portions 102B and 112C to improve the armature's response, reduce wear on the impact surfaces and variations in the working air gap between the respective end portions 102B and 112C. The surface treatments can include coating, plating or case-hardening. Coatings or platings can include, but are not limited to, hard chromium plating, nickel plating or keronite coating. Case hardening on the other hand, can include, but are not limited to, nitriding, carburizing, carbonitriding, cyaniding, heat, flame, spark or induction hardening.

The surface treatments will typically form at least one layer of wear-resistant materials on the respective end portions 102B and 112C. These layers, however, tend to be inherently thicker wherever there is a sharp edge, such as between junction between the circumference and the radial end face of either portions. Moreover, this thickening effect results in uneven contact surfaces at the radially outer edge of the end portions. However, by forming the wear-resistant layers on at least one of the end portions 102B and 112C, where at least one end portion has a surface generally oblique to longitudinal axis A—A, both end portions are now substantially in mating contact with respect to each other.

The guide member 126, the seat 128, and the orifice disk 130 form a seat assembly that is coupled at the outlet end 100B of fuel injector 100 by a suitable coupling technique, such as, for example, crimping, welding, bonding or riveting. Preferably, the seat is welded to the body 120. The seat 128 includes a flow portion 128A and a securement portion 128B. The flow portion 128A extends generally along the longitudinal axis A—A over a first length L1, and the securement portion 128B extends generally along the longitudinal axis over a second length L2 such that the second length is at least equal to the first length L1 and preferably greater than L1. Both portions extend generally along the longitudinal axis over a third length L3 greater than either one of L1 or L2.

The flow portion 128A of the seat 128 defines a sealing surface 128C and a seat orifice 128D preferably centered on the axis A—A and through which fuel can flow into the internal combustion engine (not shown). The sealing surface 128C surrounds the seat orifice 128D. The seat orifice 128D is coterminus with an orifice disk retention surface 128E. The sealing surface 128C, which faces the interior of the body 120, can be frustoconical or concave in shape, and can have a finished surface. An orifice disk 130 can be used in connection with the seat 128 to provide at least one precisely sized and oriented orifice 130A in order to obtain a particular fuel spray pattern and targeting. The precisely sized and oriented orifice 130A can be disposed on the center axis of the orifice disk 130 or, preferably disposed off-axis, and oriented in any desirable angular configuration relative to one or more reference points on the fuel injector 100. It should be noted here that both the valve seat 128 and orifice disk 130 are fixedly attached to the body 120 by a suitable attachment techniques, including, for example, laser welding, crimping, and friction welding or conventional welding. The orifice disk 130 is preferably tack welded to the orifice disk retention surface 128E of the seat 128 in a fixed spatial axial orientation to provide the particular fuel spray pattern and targeting of the fuel spray.

The securement portion 128B of the seat 128 allows a dimensional symmetry of at least one of the seat 128 and the orifice disk 130 relative to the longitudinal axis and the fixed spatial axial orientation of the seat 128 and the orifice disk 130 relative to at least one of the seat 128 and disk retention surface 128E to be maintained even after the seat is secured to the body. The securement portion 128B can be attached to the body by a suitable technique, such as, for example, tack welding or by bonding. Preferably, the securement portion 128B is secured to the inner surface of the body 120 with a continuous laser seam weld 132 extending from the outer surface through the inner surface of the body 120 and into a portion of the securement portion 128B over the entire circumference of the body about the longitudinal axis such that the seam weld 132 forms a hermetic lap seal between the inner surface of the body and the outer surface of the securement portion 128B. Also preferably, the seam weld 132 has its center located at a location over an approximate fourth length of L4 along the longitudinal axis of about 50% of the second length L2 from the orifice disk retention surface 128E. By locating the seam weld 132 at such a position from the flow portion 128A, orifice 128D and orifice disk 130, a fixed configuration of the orifice disk 130 (relative to the seat 128 prior to their installation in the body 120) is maintained within a tolerance of ±0.5% and that the dimensional symmetry (i.e., circularity roundness, perpendicularity or a suitably quantifiable measurement of distortion) of the seat 128 or the orifice disk 130 about the longitudinal axis A—A is approximately less than 1% as compared to such measurements prior to the seat being secured in the body.

According to a preferred embodiment, the magnetic flux generated by the electromagnetic coil 108A flows in a magnetic circuit that includes the pole piece 102A, the armature assembly 112, the body 120, and the coil housing 124. The magnetic flux moves across a side airgap between the homogeneous material of the magnetic portion or armature 112A and the body 120 into the armature assembly 112 and across a working air gap between end portions 102B and 112C towards the pole piece 102A, thereby lifting the closure member 112B away from the seat 128. Preferably, the width of the impact surface 102B of pole piece 102A is greater than the width of the cross-section of the impact surface 112C of magnetic portion or armature 112A. The smaller cross-sectional area allows the ferro-magnetic portion 112A of the armature assembly 112 to be lighter, and at the same time, causes the magnetic flux saturation point to be formed near the working air gap between the pole piece 102A and the ferro-magnetic portion 112A, rather than within the pole piece 102A.

The first injector end 100A can be coupled to the fuel supply of an internal combustion engine (not shown). The O-ring 134 can be used to seal the first injector end 100A to the fuel supply so that fuel from a fuel rail (not shown) is supplied to the inlet tube 102, with the O-ring 134 making a fluid tight seal, at the connection between the injector 100 and the fuel rail (not shown).

In operation, the electromagnetic coil 108A is energized, thereby generating magnetic flux in the magnetic circuit. The magnetic flux moves armature assembly 112 (along the axis A—A, according to a preferred embodiment) towards the integral pole piece 102A, i.e., closing the working air gap. This movement of the armature assembly 112 separates the closure member 128 from the seat 128 and allows fuel to flow from the fuel rail (not shown), through the inlet tube 102, passageway 104A, the through-bore 112D, the apertures 112E and the body 120, between the seat 128 and the closure member 112B, through the opening, and finally through the orifice disk 130 into the internal combustion engine (not shown). When the electromagnetic coil 108A is de-energized, the armature assembly 112 is moved by the bias of the resilient member 110 to contiguously engage the closure member 112B wit the seat 128, and thereby prevent fuel flow through the injector 100.

While the present invention has been disclosed with reference to certain embodiments, numerous modifications, alterations and changes to the described embodiments are possible without departing from the sphere and scope of the present invention, as defined in the appended claims. Accordingly, it is intended that the present invention not be limited to the described embodiments, but that it has the full scope defined by the language of the following claims, and equivalents thereof.

We claim:

1. A fuel injector comprising:

a housing having a passageway extending between an inlet and an outlet along a longitudinal axis, the housing including a body proximate the outlet;

an armature assembly disposed in the body, the armature assembly having a closure member; and a seat assembly disposed in the body, the seat assembly including:

a unitary seat including:

a flow portion, the flow portion extending along the longitudinal axis between a first surface and an orifice disk retention surface at a first length, the flow portion having a seat orifice extending therethrough; and a securement portion, the securement portion extending along the longitudinal axis away from the orifice disk retention surface at a second length greater than the first length; and an orifice disk coupled to the orifice disk retention surface so that the orifice disk is aligned in a fixed spatial axial orientation with respect to the flow portion; and at least one weld extending from an outer surface of the body to the surface of the securement portion at a location distal to the flow portion so that the seat and the orifice disk generally maintains its fixed spatial axial orientation with the flow portion.

2. A fuel injector comprising:

a housing having a passageway extending between an inlet and an outlet along a longitudinal axis, the housing including a body proximate the outlet;

an armature assembly disposed in the body, the armature assembly having a closure member; and a seat assembly disposed in the body, the seat assembly including:

a unitary seat including:

a flow portion, the flow portion extending along the longitudinal axis between a first surface and an orifice disk retention surface at a first length, the flow portion having a seat orifice extending therethrough; and a securement portion, the securement portion extending along the longitudinal axis away from the orifice disk retention surface at a second length greater than the first length; and an orifice disk coupled to the orifice disk retention surface so that the orifice disk is aligned in a fixed spatial axial orientation with respect to the flow portion; and at least one weld extending from an outer surface of the body to the surface of the securement portion at a location distal to the flow portion so as to form a generally bermetic seal between the body and the seat.

3. A fuel injector comprising;

a housing having a passageway extending between an inlet and an outlet along a longitudinal axis, the housing including a body proximate the outlet;

an armature assembly disposed in the body, the armature assembly having a closure member; and a seat assembly disposed in the body, the seat assembly including a unitary seat including;

a flow portion, the flow portion extending along the longitudinal axis between a first surface and an orifice disk retention surface at a first length, the flow portion having a seat orifice extending therethrough; and a securement portion, the securement portion extending along the longitudinal axis away from the orifice disk retention surface at a second length greater than the first length; and an orifice disk coupled to the orifice disk retention surface so tat the orifice disk is aligned in a fixed spatial axial orientation with respect to the flow portion; and at least one weld extending from an outer surface of the body to the surface of the securement portion at a location distal to the flow portion so that the seat maintains a dimensional symmetry about the longitudinal axis.

4. The fuel injector of claim 1, wherein the at least one weld is located on the outer surface of the body at a length of approximately 50% of the second length along the longitudinal axis.

5. The fuel injector of claim 4, wherein the housing comprises:

an inlet tube having a first end and a second end, the second end of the inlet tube having an end portion confronting an end portion of the armature assembly;

a filter being disposed proximate the first end of the inlet tube;

a resilient member having one portion disposed proximate the second end of the inlet tube and another portion disposed within a pocket in the armature assembly; and an adjusting tube being located within the inlet tube, the adjusting tube engaging the one portion of the resilient member so as to bias the closure member towards a position occluding flow through the seat orifice.

6. The fuel injector of claim 5, wherein the armature assembly comprises an armature coupled to a needle.

7. The fuel injector of claim 6, wherein the needle comprises an end being generally hemispheric about the longitudinal axis.

8. The fuel injector of claim 7, further comprising a pole piece, and wherein the inlet tube and the pole piece comprises a one-piece member.

9. The fuel injector of claim 8, wherein the flow portion comprises:

a sealing surface co-terminus with the first surface and contiguous to the seat orifice.

10. The fuel injector of claim 9, wherein the seat comprises:

a perimeter cincturing the flow portion and the securement portion, the perimeter extending along the longitudinal axis between a first perimeter end and a second perimeter end over a third length greater than the second length.

11. The fuel injector of claim 10, wherein the seat assembly further comprises a guide member contiguous to the first perimeter end of the seat, the guide member being provided with a central through opening along the longitudinal axis and a plurality of through openings disposed about the central opening, the central through opening guiding the closure member along the longitudinal axis between the first position where the closure member occludes fuel flow through the seat orifice and the second position where the closure member is spaced from the seat orifice so as to permit fuel flow through the seat orifice.

12. The fuel injector of claim 11, wherein the orifice disk has a plurality of through openings being disposed about the longitudinal axis and is in fluid communication with the seat orifice.

13. The fuel injector of claim 12, wherein the armature comprises at least one opening generally oblique to the longitudinal axis and extending through the surface of the armature.

14. The fuel injector of claim 13, wherein the armature comprises an inner surface telescoping over an outer surface of the closure member.

15. The fuel injector of claim 2, wherein the at least one weld is located on the outer surface of the body at a length of approximately 50% of the second length along the longitudinal axis.

16. The fuel injector of claim 3, wherein the at least one weld is located on the outer surface of the body at a length of approximately 50% of the second length along the longitudinal axis.

* * * * *